US006342031B1

(12) United States Patent
Vaughan

(10) Patent No.: US 6,342,031 B1
(45) Date of Patent: Jan. 29, 2002

(54) WATER GAITERS AND SLEEVES

(76) Inventor: Stephanie R. Vaughan, 115 Old Forest Cir., Winchester, VA (US) 22602

( * ) Notice: Subject to any disclaimer, the term of this patent is extended or adjusted under 35 U.S.C. 154(b) by 587 days.

(21) Appl. No.: 08/968,871

(22) Filed: Nov. 5, 1997

Related U.S. Application Data

(63) Continuation of application No. 08/516,178, filed on Aug. 17, 1995, now abandoned.

(51) Int. Cl.[7] ..... A63B 31/00; A63B 31/10; A63B 31/11; A63B 31/12

(52) U.S. Cl. ..... 482/55; 441/58; 441/59; 441/60; 441/61; 434/254

(58) Field of Search ..... 482/55, 111, 124; 441/57–62, 88, 102, 122, 55–56; D21/801, 803, 804, 806, 807; 602/3; 434/254

(56) References Cited

U.S. PATENT DOCUMENTS 1,128,682 A * 2/1915 Homewood ..... 441/59
2,692,995 A * 11/1954 Bihan ..... 441/57
3,286,287 A * 11/1966 Martin ..... 441/57
4,300,759 A * 11/1981 Caplan ..... 482/111
4,804,326 A * 2/1989 Lennon ..... 482/55
4,905,991 A * 3/1990 Alston ..... 482/55
5,092,802 A * 3/1992 Jones ..... 441/88
5,219,308 A * 6/1993 Rothhammer ..... 441/88

* cited by examiner

*Primary Examiner*—Denise Pothier
(74) *Attorney, Agent, or Firm*—William H. Holt

(57) ABSTRACT

Exercise devices in the form of gaiters and gloves for use during exercising in water, particularly in "deep water" with the user in generally vertical orientation. The devices are form fitting, resilient so as to preclude inadvertent injury during use, and adaptable for use by young and old, the physically fit, the lame or somewhat infirmed. When not in use, the devices are generally oval in cross-section. During use the devices conform to the user's arms and/or legs and provide a snug fit for precluding or minimizing slipping and misadjustment and provide a buoyant force on the order of two to ten pounds, more or less; a force of approximately three to six pounds is about right for a young adult lady.

5 Claims, 3 Drawing Sheets

WATER GAITERS AND SLEEVES

This application is a continuation of application Ser. No. 08/516,178, filed Aug. 17, 1995, now abandoned.

This invention relates to new and improved devices for use in water therapy, exercising and swimming to strengthen muscles, improve muscle tone and enhance muscular coordination and also, more particularly, relates to buoyant gaiters and sleeves for use while performing therapy or exercises in water, such as in swimming pools, lakes, streams, hot tubs, whirlpool baths and the like.

BACKGROUND OF THE INVENTION

It is well known that exercising in water can be very beneficial for most persons, whether they are young or old, weak or strong, sick or healthy, but such exercise is particularly appropriate for persons suffering from, for example, arthritis, rheumatism, some forms of heart conditions, ailments of the knee, back or elbow, or other minor problems with the joints and/or muscles. Maladies of these types can prevent such persons from participating in dry-land aerobics, sports or other forms of physical exercise; however, less stress and strain is incurred in water because of the effect of buoyancy and the yielding resistance exhibited by water, thus most of these persons can, and should, become involved in water exercise and therapy programs.

Various types of apparatus, devices or contrivances have been previously provided for use in conjunction with water activities. U.S. Pat. No. 4,300,759 discloses an aquatic exercise device which is to be attached to a user's ankle with Velcro® (brand) hook-and-loop fasteners; U.S. Pat. No. 1,128,682 shows a swimming device including leggings and stirrups; U.S. Pat. Nos. 4,813,668 and 5,031,904 show aquatic boots with complex adjustable structures; U.S. Pat. Nos. 4,905,991 and 4,292,126 disclose weights for use in swim training; U.S. Pat. No. 4,858,913 discloses a buoyant exercise aid for use on the ankle or foot; while U.S. Pat. No. 1,260,931 discloses an appliance to be worn on a swimmer's ankles for increasing speed. These patents show devices of somewhat complex configurations and arrangements, several relying on adjustable straps, buckles, ties and the like which are susceptible to poor adjustment resulting in slippage, twisting and turning, with possible damaging or hazardous consequences.

SUMMARY OF THE INVENTION

The present invention is designed primarily for use in water such as pools, lakes, relatively calm ocean waters, streams, whirlpool baths, hot tubs and the like and is unique in its simplicity, has a lack of adjustable and troublesome gadgetry such as snaps and buckles, and is comprised of user-friendly, soft, flexible, resilient materials that will not cause injury when brought into forceful contact with the user's appendages (arms and legs) which may occur during vigorous exercising. The invention is comprised of gaiters, also referred to as spats or leggings, for use around a person's ankles and calves and is also comprised of gloves, and/or sleeves for use around a person's wrists and forearms. The gaiters and sleeves have a similar construction in that each includes a tubular, form fitting portion for creating a snug fit with the user's ankles and calves or with the wrist and forearm, and a loop end portion which bifurcates or divides an open end of the tubular portion for aiding in fitting, attaching and positioning the gaiters on the foot, ankle and leg and positioning the sleeves on the hand, wrist and forearm of the user's body and keeping the gaiters and sleeves snug and in place while exercise is being performed.

Use of both the gaiters and sleeves, one on each of the user's arms and legs, is particularly useful in, but not limited to, the performance of "deep water exercise", that is, exercising in water sufficiently deep that the user's feet do not rest on or touch the bottom when the user's head is above the water level. The users, in a manner somewhat similar to treading water, can maintain their bodies in a generally vertical orientation through gentle manipulation of the gaiters and sleeves with their legs and arms. A gentle exercise of this nature is well within the capacities of the physical fit, young children, adults, the elderly, or the somewhat infirmed person. It should be noted, however, that the gaiters are not limited to use in a vertical position but are also useful with the user's body in a generally horizontal, floating position or while swimming. As a matter of fact, the invention can be particularly useful for teaching the art of swimming by aiding neophyte swimmers to raise their legs to a nearly horizontal, swimming position. Further, the invention is useful to develop muscle strength, even for seasoned athletes, because the gaiters and/or sleeves provide increased resistance to movement of a person's legs and arms through water during vigorous water exercise.

It is an object of the invention to provide an exercise device comprising a resilient, flexible, generally tubular body member having an open portion for receiving a person's appendage, i.e., an arm or leg, of a user and having a stop member in the form of a connecting strap or loop for limiting movement of the body member upon the user's arm or leg when the device is used for exercising in water, the tubular body member being comprised of buoyant material.

Another object of the invention is to provide exercise apparatus comprising a plurality of buoyant devices, in the form of gaiters and sleeves, for being worn upon each leg and arm of a user wherein each of said devices creates a buoyant force, when in water, the buoyant force being in the range of about one pound to about fifteen pounds for average sized men and women, and somewhat more for larger or stronger persons such as college and professional athletes.

A further object of the invention is to provide a resilient, buoyant device for being worn upon a leg or arm of a user wherein the device includes an elasticized covering for inducing the gaiters and/or sleeves to elastically conform to a user's leg or arm during use thereby providing protection against slippage and also providing cushioning to protect the user's ankles, calves, wrists and forearms or anything with which they may come into contact.

DESCRIPTION OF THE PREFERRED EMBODIMENTS

Figure 3:
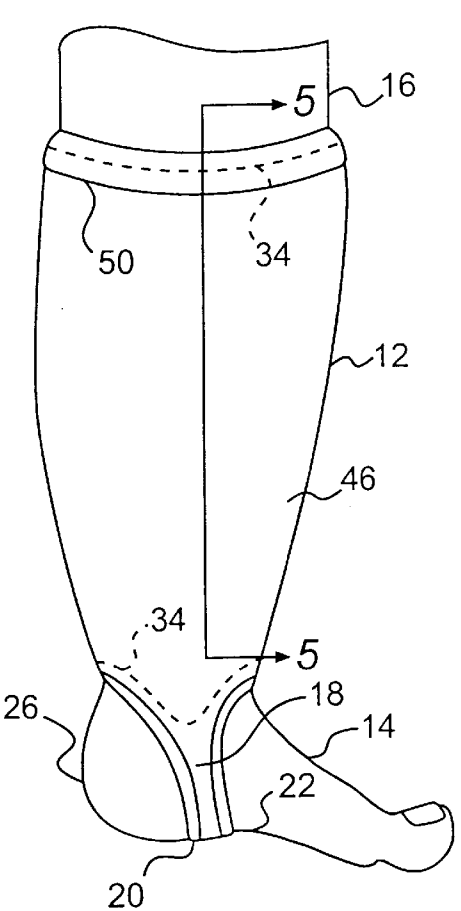
FIG. 3 is a side elevational view of the component shown in FIG. 2 and shows a connecting strap which extends under the sole of a user's foot.
Figure 2:
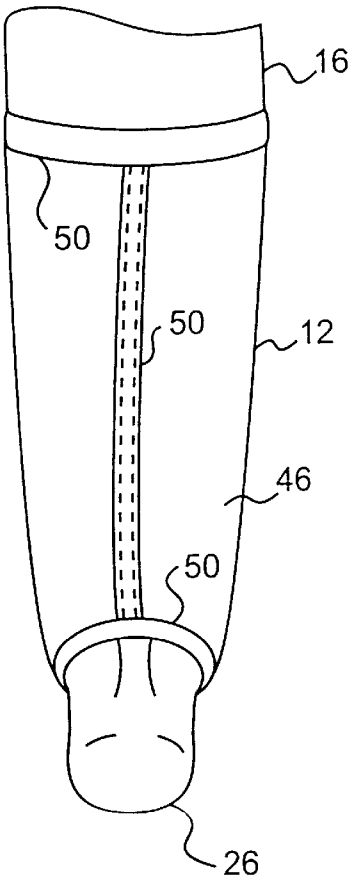
FIG. 2 is a rear elevational view of one component of the invention and illustrates the use of a sewn seam for constructing one embodiment thereof.
Figure 1:
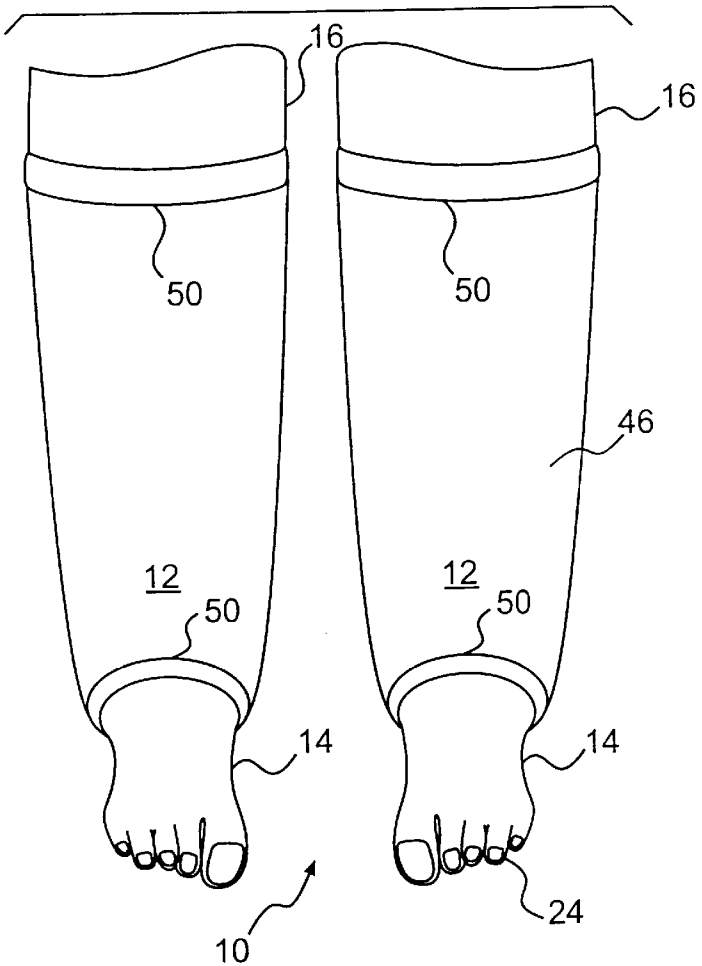
FIG. 1 is a front, elevational view of a person's left and right legs which are provided with a spat or legging, each being in the form of a gaiter which comprises a part of the present invention.

Referring now to the drawings in detail, FIGS. 1–6 illustrate a first embodiment of the invention and show one form of an exercise device, generally indicated by the numeral 10, comprised of a resilient, generally tubular body member in the form of a gaiter 12 (sometimes referred to as a spat and/or a legging) being worn about a person's foot 14 and extending along the ankle and calf 16.

Figure 8:
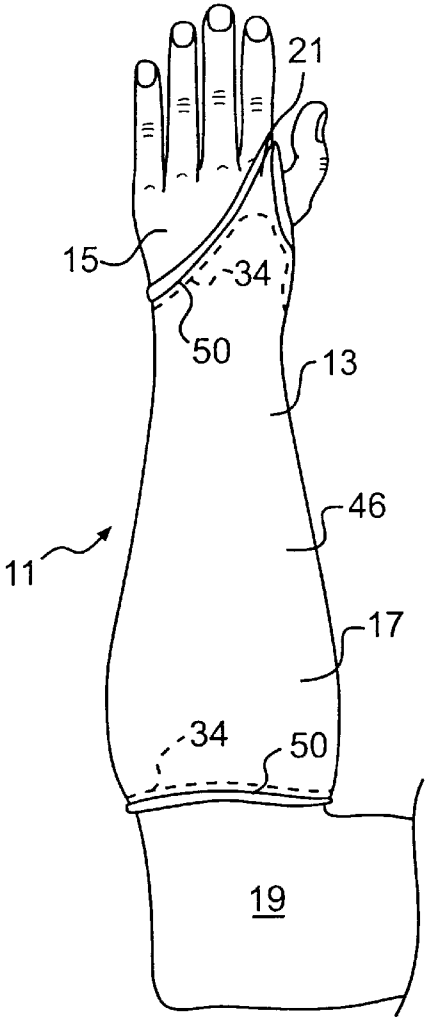
FIG. 8 is a view of a second component of the invention in the form of a sleeve, or glove, having an extended sleeve portion covering much of the user's wrist and forearm and having a connecting loop or strap preferably extending between the user's thumb and forefinger where it can be grasped by the user's hand.
Figure 7:
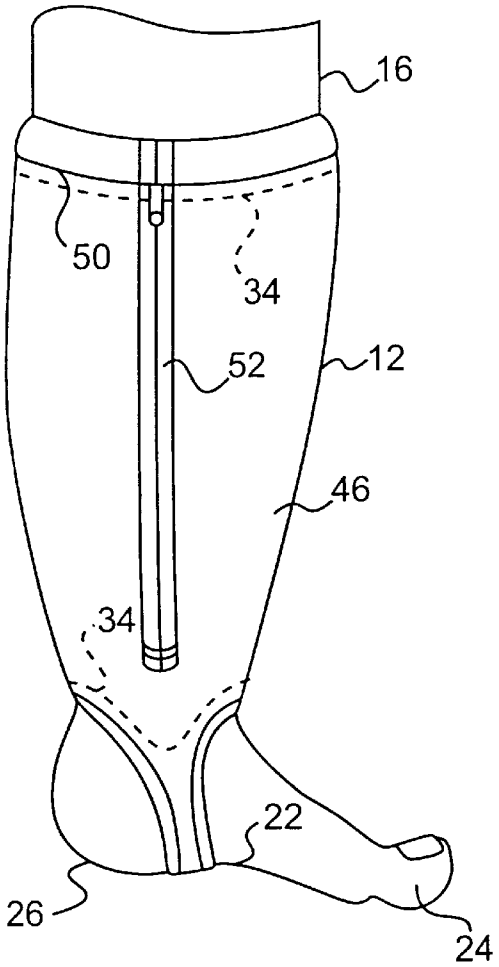
FIG. 7 is a side elevational view, similar to the showing in FIG. 3, and illustrates a second embodiment of the gaiters of the present invention.

A second but quite similar form of the invention comprises an exercise device, generally indicated by the numeral 11, and shown in FIG. 8 as being comprised of a resilient, generally tubular body member in the form of an extended length of a glove or sleeve 13 being worn about a person's hand 15 and extending along the wrist and forearm 17 between the hand 15 and elbow 19.

Figure 4:
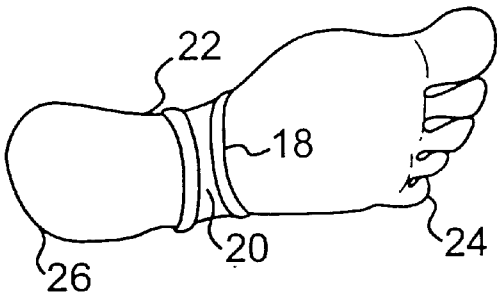
FIG. 4 is a bottom view of the component shown in FIG. 3.

Each gaiter 12 includes a stop member in the form of an end loop, or strap, 18 which provides a strap member 20 extending under the user's instep 22 between the toes 24 and heel 26, as is best shown in FIGS. 3 and 4. The strap, or stop member 18, functions to close the bottom end of gaiter 12 for limiting movement thereof and keeping it from sliding upwardly upon the user's ankle and calf 16 when the device is being used in water during swimming, exercising and/or therapy.

Likewise, each sleeve 13 includes a stop member in the form of an end loop, or strap, which provides a strap member 21 extending about the users palm and hand 15, as will be understood from the showing in FIG. 8. The strap, or stop member 21, functions to close one end of the sleeve 13 for limiting movement thereof and keep it from sliding upwardly upon the user's wrist and forearm 17 when the device is being used in water during swimming, exercising and/or therapy.

Figure 5:
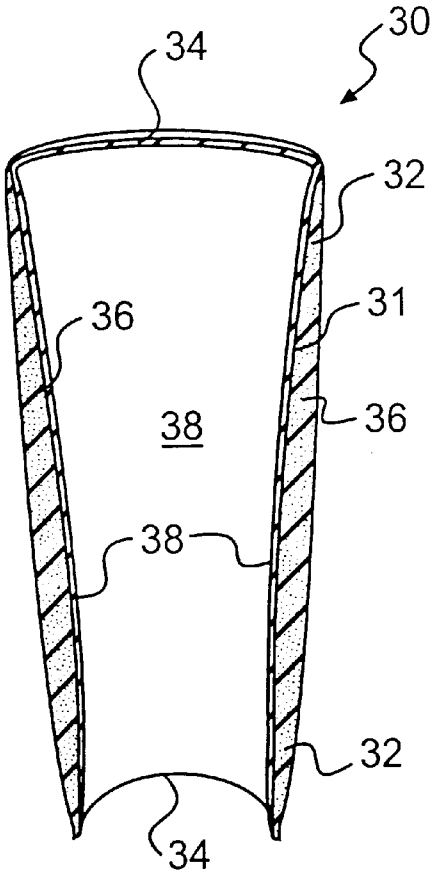
FIG. 5 is a fragmentary, vertical section, taken on line 5—5 of FIG. 3, and is limited to showing a core portion of foam material having an inner fabric lining for contacting the user's skin.

The exercise devices, gaiter 12 and sleeve 13, are similarly constructed of buoyant material, preferably in the form of flexible, foam rubber or the like and ideally, as is shown in FIG. 5, in the form of a sheet member, generally indicated by the numeral 30, which is sufficiently flexible to allow for cutting and shaping thereof into a configuration for fitting about a person's ankle and calf 16, or wrist and forearm 17. The sheet member 30, which is preferably between one-half to three inches in thickness, having a length between four and twenty four inches providing a volume for creating a buoyant force in the range of approximately one to fifteen pounds, can be provided with foam material 31 having thin marginal portions 32 and 34 and have a thicker central portion 36 to allow for a somewhat tailored fit and avoid a semblance of being bulky at the open ends of the tubular portions. The sheet member 30 is shown in FIG. 5 as including a layer of fabric 38, such as woven nylon, which may be laminated or adhered by heat, adhesives, solvents, or the like, to the inside surface of sheet member 30 for strengthening the foam material 31 against tearing, while allowing it to stretch to some degree to accommodate and provide a form fit with a user's leg or arm (as shown in FIGS. 1, 2, 3, 7 and 8), the fabric 38 also providing a comfortable surface to be in contact with the user's skin.

Figure 6:
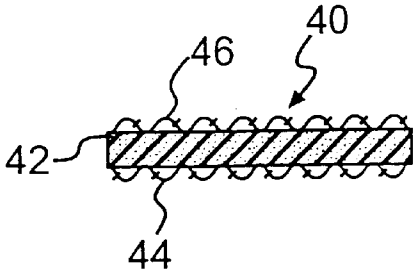
FIG. 6 is an enlarged, fragmentary section of a portion of a preferred outer fabric which covers the outer portion of the component shown in FIGS. 1–5.

It is to be understood that the sheet member 30, as shown in FIG. 5, comprises an inner component of the gaiters 12 or sleeves 13. The outermost component or cover member of the gaiters 12 and sleeves 13 is preferably comprised of sheet material in the form of laminated, elasticized fabric of a type commonly used for apparel known as "wet suits" which are generally worn for use during extended swimming, underwater diving, and/or exposure to cold water. An enlarged, fragmentary sectional view of a preferred elasticized cover member, generally indicated by the numeral 40, is shown in FIG. 6 as being comprised of a central core of foam material 42 constructed of foam rubber, or foam synthetic material such as neoprene and the like, sandwiched between and adhered to an inner, woven fabric layer 44 and an outer, woven fabric layer 46. Outer fabric layer 46 may provide a fashion touch of multiple colors in various patterns, designs and styles.

Fabric layers 44 and 46 serve to protect the foam material 42 and also provide elasticity for the cover member 40 such that the gaiters and sleeves will snugly adhere to the user's leg and/or arm. As previously described, a similar function is provided by foam material 31 and fabric 38. The layers of fabric 38, 44 and 46, in addition to providing elasticity can be used to provide closure means in the form of sewn seams, indicated by the numeral 50, along the top, bottom and rear portions (see FIG. 2) of the gaiters 12 and sleeves 13. The embodiment shown in FIG. 7 includes an alternative closure means in the form of a slide fastener 52 in lieu of, or in addition to, the back seam 50 in FIG. 2 to provide for ease in donning or removing the devices. It is also to be understood that hook and loop fasteners, such as sold under the Velcro® brand name, may be used as closure means in lieu of rear sewn seam 50 (in FIG. 2) or the slide fastener 52 (in FIG. 7) and also to adjust and secure strap members 20 and 21. The presently preferred embodiments are, however, those shown in the drawings and described in this specification.

Figure 9:
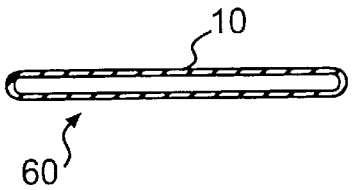
FIG. 9 is a schematic view, reduced in scale, looking at the open-end of either the gaiter of FIGS. 1–4, FIG. 7 or the sleeve of FIG. 8 with the gaiter or sleeve being removed from the user's leg and/or arm.

FIG. 9 provides a fragmentary, schematic, cross-sectional view illustrating an oval shape 60 indicative of the shape of an exercise device 10, either a gaiter or sleeve, when in repose prior to or after being worn by a person. An important part of the present invention resides in the fact that the elasticized materials previously described cause the gaiters 12 or sleeves 13 to snugly grip, or adhere to, or close upon a user's leg or arm when the oval shape is changed from one of repose to a more cylindrical shape that is required for enclosing a person's leg or arm. This feature is readily understood by keeping in mind that the preferred construction will tend to cause the devices to assume the oval shape 60 whether or not the devices are being worn.

It will be apparent that at least a few different sizes of gaiters 12 and sleeves 13 will be needed to accommodate persons of varying sizes. Children, teenagers and adults of small, average and large size have different needs and requirements. Thus, lengths can vary in accordance with the measurements between the foot and knee, and between the hand and elbow. It is contemplated that, for example, a gaiter length or sleeve length of about ten inches, and a total thickness in repose of about three inches, will be suitable for an average sized adult for use in "deep water exercising" and will each provide a buoyant force on the order of approximately four pounds. It is well within the scope of the invention to provide thicknesses of foam on the order of perhaps three inches thick, and larger lengths such as twelve to sixteen inches, for devices to be used by tall and heavy persons, including professional athletes and the like, to displace sufficient water to create a buoyant force of perhaps fifteen pounds.

The foregoing descriptions are directed to preferred embodiments of the present invention and to the presently contemplated best mode for construction and forming of the disclosed exercise devices. It is, of course, understood that various modifications and changes may be made thereto without departing from the spirit and scope of the invention which are to be determined in accordance with the following claimed subject matter.

What is claimed is:

1. An exercise device for providing buoyancy for deep water exercise, said device comprising a resilient tubular body member being open at one end thereof for receiving a user's appendage and the other end of said body member having a loop member for limiting movement of said body member upon the user's appendage, said tubular body member being formed of buoyant material comprised of foam material shaped for having thin marginal portions adjacent said one end and adjacent said loop member for minimizing interference with other appendages of the user and including a cover material of elasticized fabric, said tubular body member being in the form of a generally closed oval in cross-section when in repose and generally cylindrical in use for elastically conforming to a user's appendage for minimizing slippage thereon and for further minimizing interference with an adjacent appendage.

2. An exercise device as defined in claim 1 wherein said loop member is arranged for being placed about a user's foot and said tubular body member closely conforms to a user's ankle and calf.

3. An exercise device as defined in claim 1 wherein said loop member is arranged for being placed between a user's thumb and forefinger and said tubular body member closely conforms to a user's wrist and forearm.

4. An exercise device as defined in claim 1 wherein said buoyant material creates a buoyant force in water on the order of approximately two to ten pounds for limiting the force needed for maintaining the user in a generally vertical orientation in deep water.

5. An exercise device as defined in claim 1 including a slide fastener device (52) for closing said tubular body member.

* * * * *